US005209680A

United States Patent [19]

Fry

[11] Patent Number: 5,209,680

[45] Date of Patent: May 11, 1993

[54] MALE ELECTRICAL TERMINAL WITH ANTI-OVERSTRESS MEANS

[75] Inventor: Rupert J. Fry, Des Plaines, Ill.

[73] Assignee: Molex Incorporated, Lisle, Ill.

[21] Appl. No.: 819,422

[22] Filed: Jan. 10, 1992

[51] Int. Cl.[5] ..... H01R 13/00

[52] U.S. Cl. ..... 439/825

[58] Field of Search ..... 439/816, 825-827

[56] References Cited

U.S. PATENT DOCUMENTS

| | | | |
|---|---|---|---|
| 1,376,735 | 5/1921 | Stalhane et al. | 439/825 |
| 3,581,272 | 5/1971 | Yopp et al. | 439/825 |
| 3,588,789 | 6/1971 | Kailus | 439/825 |
| 4,416,504 | 11/1983 | Sochor | 339/252 P |
| 4,820,207 | 4/1989 | Zic | 439/825 |

FOREIGN PATENT DOCUMENTS 2044557 1/1980 United Kingdom .

*Primary Examiner*—Joseph H. McGlynn

*Attorney, Agent, or Firm*—Stephen Z. Weiss

[57] ABSTRACT

A male electrical terminal is stamped and formed from sheet metal material and includes a rear terminating portion and a front mating portion. The mating portion is formed by at least three forwardly extending cantilevered beams to allow inward flexing movement of the beams relative to each other. The beams are formed with inwardly tapered free ends positioned and configured relative to each other such that each inwardly tapered free end is engageable with an edge of at least another inwardly tapered free end when any beam is over-flexed inwardly to provide complementarily interengaging anti-overstress means between the beams.

11 Claims, 1 Drawing Sheet

MALE ELECTRICAL TERMINAL WITH ANTI-OVERSTRESS MEANS

FIELD OF THE INVENTION

This invention generally relates to the art of electrical connectors and, particularly, to a male terminal or pin which includes a plurality of flexible beams provided with anti-overstress means between the beams.

BACKGROUND OF THE INVENTION

Mating electrical connectors often are provided with complementarily mating male and female terminals or contacts. The female terminal provides a receptacle or socket for the male terminal. Male terminals are provided in a variety of configurations, ranging from flat blades, to solid pins, to stamped and formed components having flexible beams and other similar constructions.

One type of male terminal is constructed with a plurality of cantilevered beams surrounding an open area therebetween, whereby the beams can flex inwardly when inserted into a female terminal and thereby exert outwardly directed contact forces between the terminals. Normally, such male terminals, of the cantilevered beam construction, are unitarily fabricated of stamped and formed sheet metal material.

One of the problems with male terminals of the cantilevered beam configuration is that the beams may become over-stressed in an inward direction and thereby lose their resilient capabilities of exerting outwardly directed contact forces. In other words, the beams can become overly bent inwardly toward one another. This overstressing can occur during handling, shipping, abusive use or even in subsequent manufacturing operations after the terminal is formed, such as plating and like processes.

This invention is directed to solving such problems by providing a male terminal with cantilevered contact beams which are provided with complementarily interengaging anti-overstress means therebetween.

SUMMARY OF THE INVENTION

An object, therefore, of the invention is to provide a new and improved male electrical terminal with anti-overstress means, of the character described.

In the exemplary embodiment of the invention, the male electrical terminal is stamped and formed from sheet metal material and includes a rear terminating portion and a front mating portion. The mating portion is formed by at least three forwardly extending cantilevered beams to allow inward flexing movement of the beams relative to each other. In the preferred embodiment of the invention, four cantilevered beams are arranged in a box-like array whereby any one beam is generally perpendicular to a pair of the other beams along opposite sides of the one beam.

The invention contemplates that inwardly tapered free ends of the cantilevered beams be positioned and configured relative to each other such that each inwardly tapered free end is engageable with an edge of at least another inwardly tapered free end when any beam is overflexed inwardly to provide complementarily interengaging anti-overstress means between the beams. With this construction, the inwardly tapered free ends of the beams perform a dual function. First, the tapered ends provide guide means for facilitating insertion of the male terminal into a complementary female terminal and, second, the inwardly tapered free ends provide the anti-overstress means.

With the cantilevered beams arranged in a box-like array, the inwardly tapered free end of each beam is engageable with the edge of the inwardly tapered free end of an adjacent beam in the same direction seriatim around the periphery of the box-like array of beams.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings in which like reference numerals identify like elements in the figures and in which:

DETAILED DESCRIPTION OF THE PREFERRED EMBODIMENT

Figure 1:
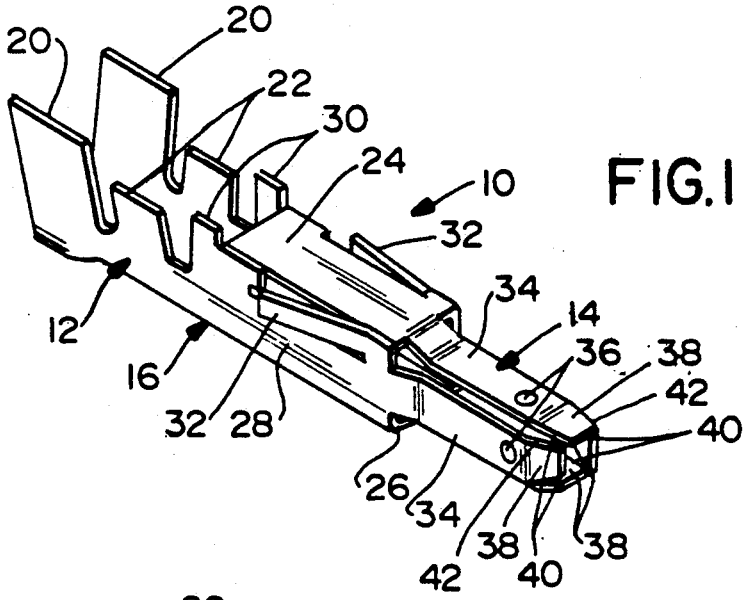
FIG. 1 is a perspective view of a male electrical terminal incorporating the concepts of the invention.

Referring to the drawings in greater detail, a male electrical terminal, generally designated 10, is shown as stamped and formed from sheet metal material. The terminal includes a rear terminating portion, generally designated 12, a front mating portion, generally designated 14, and an intermediate portion, generally designated 16, between the front mating portion and the rear terminating portion.

Rear terminating portion 12 of male terminal 10 is generally U-shaped and includes a bottom wall 18 and two pairs of crimp arms 20 and 22 projecting upwardly from the bottom wall. The male terminal may be adapted for crimping onto an insulated electrical wire which includes a stripped end of the conductor core of the wire projecting beyond the wire insulation, as is conventional in many electrical wire terminations. Crimp arms 22 would be crimped onto the exposed conductor core of the electrical wire, and crimp arms 20 would be crimped onto the wire insulation to provide strain relief for the wire.

Intermediate portion 16 of male terminal 10 is of a generally box-like configuration and includes a top wall 24, a bottom wall 26 and a pair of side walls 28. The terminal normally would be encased within an insulating housing in a through passage in the housing. A pair of stop tabs 30 may be formed integral with side walls 28, projecting upwardly beyond top wall 24, to provide abutment means and define a position of insertion of the male terminal in the insulating housing. In other words, the tabs may abut against an appropriate stop surface means on the inside of the housing passage. A pair of cantilevered spring tabs 32 are formed integral with and are angled outwardly from side walls 28 for snapping behind appropriate shoulders formed in the side walls of the housing passage to prevent the male terminal from backing out of the passage once it is inserted to a position defined by tabs 30.

Up to this point, rear terminating portion 12 and intermediate portion 16 of male terminal 10 may be considered generally as conventional and, in addition, other configurations of those portions of the terminal are contemplated as within the scope of the invention.

Mating portion 14 of male electrical terminal 10 is formed by at least three forwardly extending cantilevered beams 34 projecting forwardly of intermediate portion 16. In the preferred embodiment of the invention as depicted in the drawings, four cantilevered beams 34 are provided and arranged in a box-like array, whereby any one beam is generally perpendicular to a pair of the other beams along opposite sides of the one beam. The beams are spaced from each other to allow for inward flexing movement of the beams relative to each other when inserted into a complementary female terminal, receptacle or socket. Each beam is provided with an outwardly formed contact dimple 36 which establishes the contact engagement with surfaces of the female terminal. Therefore, when the beams are flexed inwardly upon insertion into the female terminal, contact dimples 36 exert outwardly directed contact forces due to the inherent resiliency of the beams.

The invention contemplates that each beam be provided with an inwardly directed free end 38. The free ends perform a dual function. First, they provide a guide means for facilitating insertion of the male terminal into an appropriate mating female terminal, receptacle or socket. Second, the free ends are configured and located relative to each other to provide an anti-overstress means between the beams, as described below.

Figure 2:
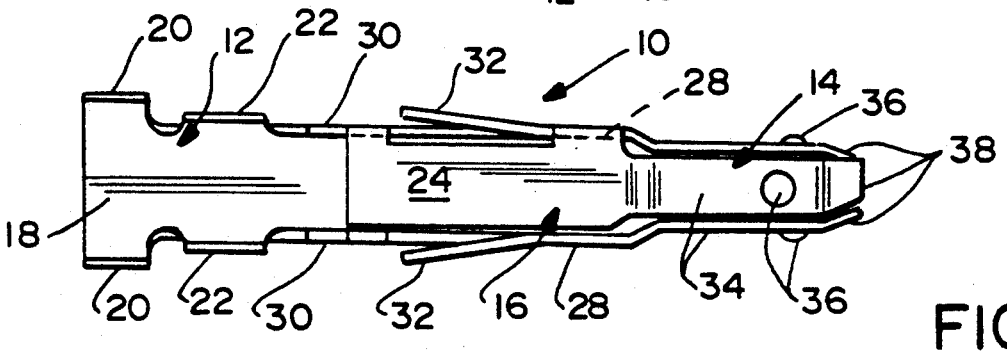
FIG. 2 is a top plan view of the male terminal.
Figure 3:
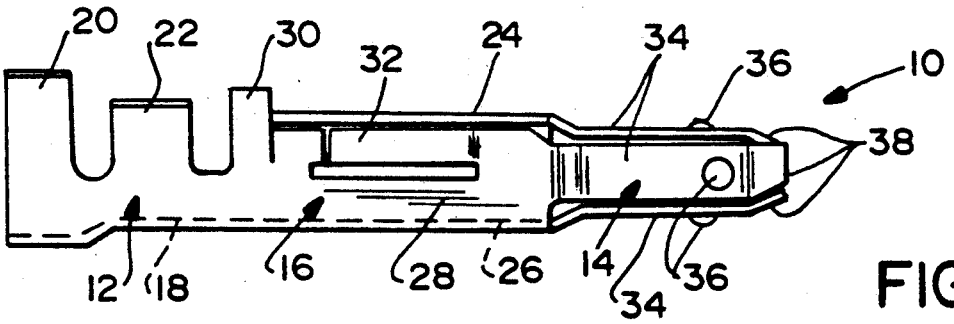
FIG. 3 is a side elevational view of the male terminal.
Figure 4:
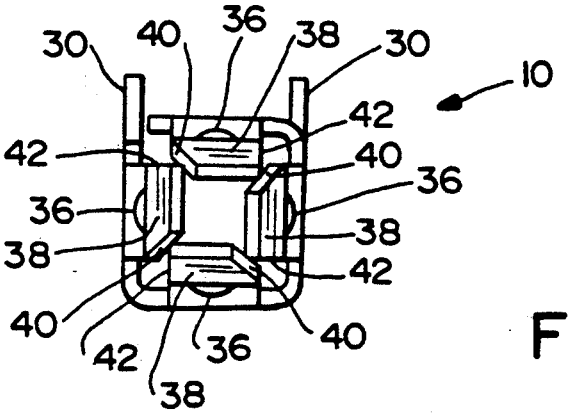
FIG. 4 is an end elevational view looking toward the mating or right-hand end of the terminal as viewed in FIGS. 1–3.

More particularly, and referring specifically to FIG. 4 in conjunction with FIGS. 1–3, each free end 38, like its respective beam 34, is of a generally planar configuration. Each free end includes an angled side edge 40. By angling side edges 40, it can be seen that the corners of opposite side edges 42 of the beams overlap the angled edges, notwithstanding the fact that the free ends are spaced from each other, as at 44 (FIG. 1), in an unstressed condition of the beams as depicted in the drawings.

With the above description of the structure and relative arrangement of free ends 38 of cantilevered beams 34, the beams are upon insertion into a complementary female terminal, allowed to flex inwardly a certain amount, at least sufficient for establishing intended mating and contacting interengagement within the female terminal. However, upon unintentional over-flexing of any one or more of the beams inwardly, the corner of edge 42 of any overflexed beam will engage or abut angled side edge 40 of an adjacent beam and thereby provide the complementarily interengaging anti-overstress means between the beams. As best seen in FIG. 4, the one edge 42 of the inwardly tapered free end 38 of any given beam 34 is engageable with the angled edge 40 of an adjacent beam in the same direction seriatim around the periphery of the box-like array of beams defining mating portion 14 of the terminal.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a male electrical terminal stamped and formed from sheet metal material and including a rear terminating portion and a front mating portion, the mating portion being formed by at least three cantilevered beams extending forward from said rear portion to allow inward flexing movement of the beams relative to each other, wherein the improvement comprises anti-overstress portions formed at the free ends of the cantilevered beams positioned and configured relative to each other such that a surface of each anti-overstress portion is engageable with a longitudinally extending edge of at least another anti-overstress portion when any beam is over-flexed inwardly to provide complementarily interengaging anti-overstress means between the beams.

2. In a male electrical terminal as set forth in claim 1, wherein said anti-overstress portions are inwardly tapered free ends of said cantilevered beams.

3. A male electrical terminal as set forth in claim 2, wherein the inwardly tapered free end of each beam is engageable with the edge of the inwardly tapered free end of an adjacent beam in the same direction seriatim around the periphery of the mating portion of the terminal.

4. A male electrical terminal as set forth in claim 2, wherein the inwardly tapered free end of each beam has one angled edge forming a reduced tip cross section resulting in an easier mating between said male terminal and a mating female terminal.

5. In a male electrical terminal as set forth in claim 2, including four of said cantilevered beams arranged in a box-like array whereby any one beam is generally perpendicular to a pair of the other beams along opposite sides of the one beams.

6. A male electrical terminal as set forth in claim 5, wherein the inwardly tapered free end of each beam is engageable with the edge of the inwardly tapered free end of an adjacent beam in the same direction seriatim around the periphery of the box-like array of beams.

7. In a male electrical terminal which includes a rear terminating portion and a front mating portion, the mating portion being formed by at least three forwardly extending cantilevered beams to allow inward flexing movement of the beams relative to each other, wherein the improvement comprises anti-overstress portions formed at the free ends of the cantilevered beams positioned and configured relative to each other such that a surface of each anti-overstress portion is engageable with the surface of at least another anti-overstress portion when any beam is over-flexed inwardly to provide complementarily interengaging anti-overstress means between the beams.

8. In a male terminal as set forth in claim 7, wherein said anti-overstress portions include inwardly tapered free ends of said cantilevered beams.

9. In a male electrical terminal as set forth in claim 8, including four of said cantilevered beams arranged in a box-like array whereby any one beam is generally perpendicular to a pair of the other beams along opposite sides of the one beam.

10. In a male electrical terminal as set forth in claim 8, wherein the inwardly tapered free end of each beam is engageable with a side portion of the inwardly tapered free end of an adjacent beam in the same direction seriatim around the periphery of the mating portion of the terminal.

11. In a male electrical terminal as set forth in claim 8, wherein the inwardly tapered free end of each beam has one angled edge forming a reduced tip cross section resulting in an easier mating between said male terminal and a mating female terminal.

* * * * *